United States Patent [19]

Boerstler et al.

[11] 4,117,344

[45] Sep. 26, 1978

[54] CONTROL SYSTEM FOR A RANKINE CYCLE POWER UNIT

[75] Inventors: Leslie H. Boerstler, Valley Forge; Walter V. Discenza, Jr., Lionville, both of Pa.; Mason D. Marvin, Cincinnati, Ohio; Theodore J. Ebersole, King of Prussia, Pa.

[73] Assignee: General Electric Company, Fairfield, Conn.

[21] Appl. No.: 646,275

[22] Filed: Jan. 2, 1976

[51] Int. Cl.[2] ..... F01D 15/10; H02P 9/04

[52] U.S. Cl. ..... 290/52; 60/667; 290/40 C

[58] Field of Search ..... 290/40 R, 40 B, 40 C, 290/52; 60/660, 664, 665, 667, 686, 39.18 R (U.S. only), 39.19 (U.S. only)

[56] References Cited

U.S. PATENT DOCUMENTS

| | | | |
|---|---|---|---|
| 3,409,782 | 11/1968 | Bronicki | 290/52 |
| 3,826,282 | 7/1974 | Noe | 60/664 |
| 3,886,748 | 6/1975 | Bronicki | 60/660 |
| 3,906,731 | 9/1975 | Carlson | 60/665 |
| 4,005,581 | 2/1977 | Aanstad | 60/660 |
| 4,039,846 | 8/1977 | Vance | 60/667 |

*Primary Examiner*—Robert K. Schaefer
*Assistant Examiner*—William L. Feeney
*Attorney, Agent, or Firm*—Raymond H. Quist; Allen E. Amgott

[57] ABSTRACT

A vapor generator supplies vaporized motive fluid to a prime mover which drives a load. In the embodiment of this disclosure the primary load is the electrical load on an alternator. A sensor provides a continuous signal representative of the load. Responsive to this signal the flows of motive fluid and fuel and air to the vapor generator are modified. Additional modifications to the flows are made responsive to signals representing the temperature and pressure of the vapor leaving the vapor generator.

4 Claims, 5 Drawing Figures

CONTROL SYSTEM FOR A RANKINE CYCLE POWER UNIT

CROSS-REFERENCES TO RELATED APPLICATIONS

This invention relates to U.S. Patent No. 4,010,378, issued on application Ser. No. 534,711, filed Dec. 20, 1974, entitled Integrated Electric Generating and Space Conditioning System.

BACKGROUND OF THE INVENTION

This invention relates generally to electrical generating systems and more particularly to the controls for such a system.

The aforementioned patent application describes a system which can be manually operated; however, manual operation would require almost constant attention due to changes in loads. Therefore, it is desirable to make operation as automatic as possible.

The systems involved are relatively small, generally less than 20 KWe. As a consequence provision must be made for abrupt changes in load which might otherwise cause stalling. For example, if the load is suddenly increased, three to five seconds will elapse before the increased flows of fuel and motive fluid produce the required mass flow of vapor.

SUMMARY OF THE INVENTION

The invention is a control system for a small (generally less than 20 KWe) external combustion power system. Vaporized motive fluid produced by a vapor generator drives a prime mover. Direct current motors are used to provide the fuel and air mixture and the liquid motive fluid to the vapor generator. As is conventional, a throttle valve controls the speed of the prime mover based on feedback from a speed sensor. A battery provides the power for starting and also provides the power for the direct current loads when sudden load increases are placed on the prime mover. A load sensor is employed to detect changes in loads and the flows of the fuel/air mixture and motive fluid are adjusted accordingly. The flows are also moderated by measuring deviations from desired temperature and pressure of the vaporized motive fluid.

DESCRIPTION OF THE PREFERRED EMBODIMENT

Figure 1:
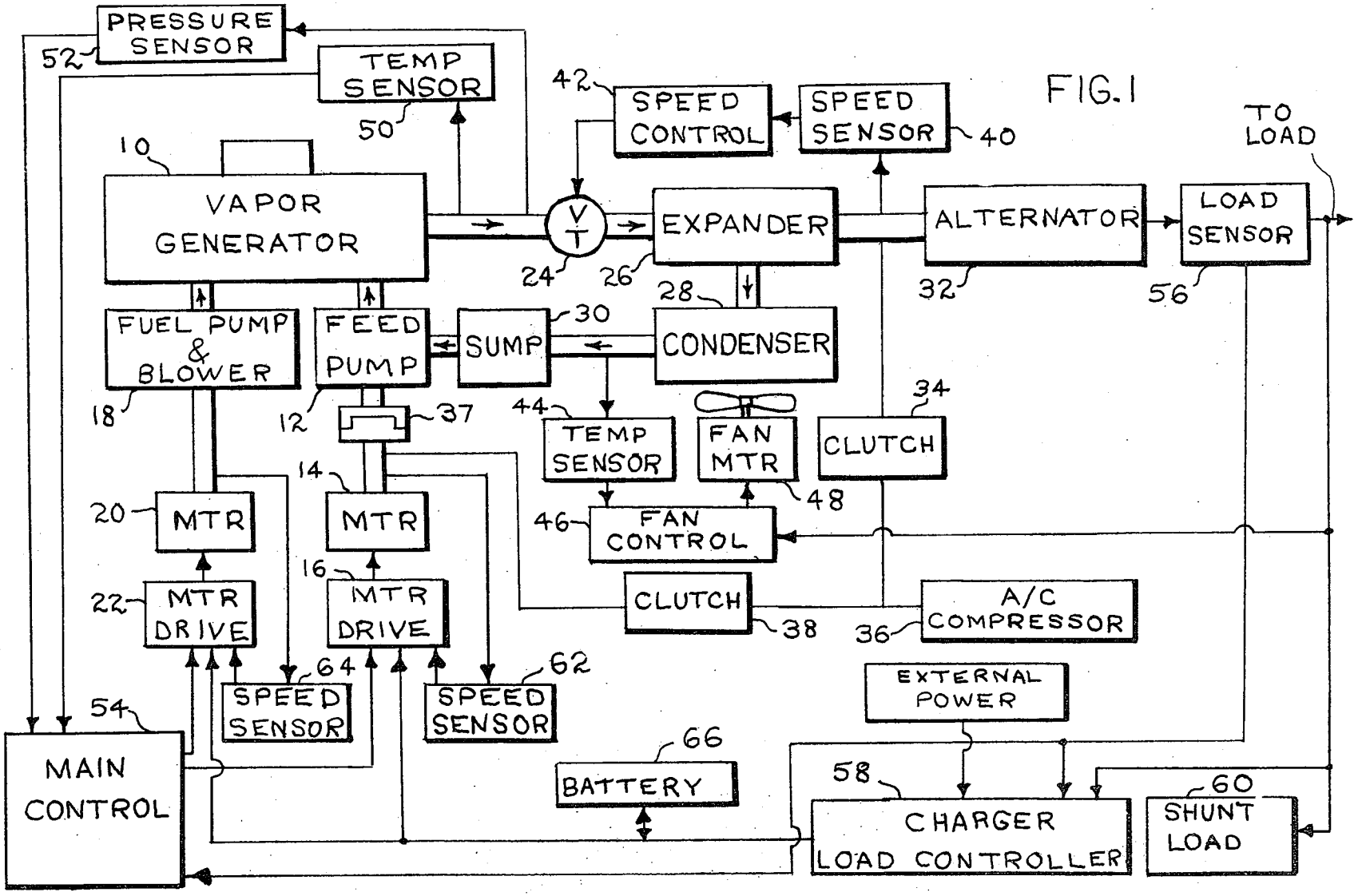
FIG. 1 is a schematic in block diagram form of one embodiment of the overall power system and controls.

Referring to FIG. 1, vapor generator 10 is supplied liquid motive fluid by feed pump 12. Feed pump 12 is driven by motor 14 together with motor drive 16. Fuel pump and blower 18 supplies a combustible mixture to vapor generator 10. Motor 20 together with motor drive 22 power fuel pump and blower 18. Vapor generator 10 includes a combustor and a monotube boiler. In the monotube boiler the fluid exists in regions of the tube as a liquid, in a two phase liquid/vapor state and as a superheated vapor. The interfaces between these regions shift as the fluid and fuel rate vary from nominal for a given flow rate. When motive fluid and combustible mixture are supplied at the proper rates, the superheated vapor produced is supplied via throttle valve 24 to expander 26.

The expanded vapor is exhausted from expander 26 and delivered to condenser 28. The condensed motive fluid then goes to sump 30 from which it is recycled.

Expander 26 drives alternator 32 at nominally 1800 RPM to produce 60 Hz alternating current. Clutch 34, when engaged, permits expander 26 to also drive air conditioning compressor 36. A/C compressor 36 can alternatively be driven by motor 14 by engaging clutch 38. In the latter case clutch 37 can be disengaged so that feed pump 12 is not driven.

In order to maintain a nearly constant alternator frequency for all loads, the rotational speed of the expander is sensed by speed sensor 40. Speed sensor 40 is conventional and sensing may be electrical, magnetic, optical or mechanical. The output of speed sensor 40 is applied to speed control 42 which opens or closes throttle valve 24 accordingly. Throttle valve 24 has a flow rate which is preferably directly proportional to stem displacement in order to simplify the controls for maintaining synchronous speed.

Temperature sensor 44 detects the temperature of the condensate leaving condenser 28. The output of temperature sensor 44 is applied to fan control 46 which regulates the speed of fan 48 so that the desired flow of cooling air to condenser 28 is maintained. In lieu of varying the speed of the fan, a constant speed fan with adjustable louvers can be employed.

When throttle valve 24 opens, a greater mass flow of vapor is desired, while still maintaining a desired temperature and pressure. Temperature sensor 50 and pressure sensor 52 measure these vapor parameters and deliver signals to main control 54. The speed control loop is designed to attempt to maintain a throttle valve position which is substantially closed down so that relatively large pressure drops are maintained across the valve, thus providing energy storage to assist in transient load acceptance.

In accordance with the invention, load sensor 56 continuously senses the electrical load on alternator 32 and delivers signals representative of the load to main control 54 and charger/load controller 58. Main control 54 delivers to motor drives 16 and 22 signals representing the speeds required of motors 14 and 20 to cause the proper amounts of motive fluid and stoichiometric fuel air mixture to be provided to vapor generator 10.

The actual speeds of motors 14 and 20 are detected by speed sensors 62 and 64 respectively and fed back to motor drives 16 and 22.

Power to start the system is provided by battery 66. Once the system is started and the load supplied, charger/load controller 58 recharges the battery, and provides energy for motors 14 and 20 and all direct current power required by the control electronics.

When the electrical load is reduced, shunt load 60 will receive the excess power until generation is reduced to the proper level. In some cases it may be found that shunt load 60 is not required.

Although the system is designed to be mobile and not require external power, when such power is available it may be supplied to charger/load controller 58 in lieu of operating alternator 32.

Figure 2:
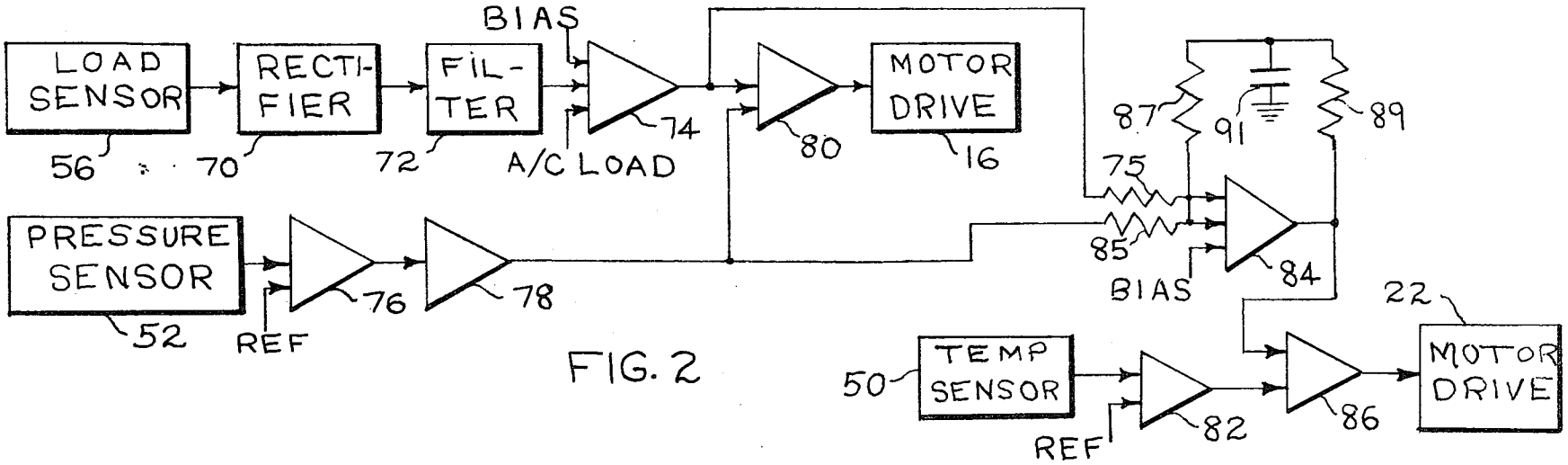
FIG. 2 is a schematic of the main control of FIG. 1.

As previously indicated, load sensor 56 delivers signals representative of the load on alternator 32 to main control 54. Load sensor 56 has been implemented as a current transformer which measures alternator output current. At a constant voltage, the signal delivered by load sensor 56 is proportional to power or load. Referring now to FIG. 2, which shows main control 54, the 60 Hz signal from load sensor 56 is applied to full wave rectifier 70. The rectified signal is smoothed in filter 72 and applied to one input terminal of amplifier 74. If expander 26 of FIG. 1 is being used to drive air conditioning compressor 36, there is an additional load which is not an electrical load and so not sensed by load sensor 56. To correct for this a signal representing the electrical load equivalent to the mechanical load of the compressor is applied to amplifier 74. In one implementation of this, the signal which engages electromagnetic clutch 34 switches an electrical signal through a resistor representing the air conditioner load. The resulting signal is applied to amplifier 74. Amplifier 74 has a fixed gain and is biased to produce a linear output which is offset. This is the basic desired speed signal.

Changing environmental conditions, aging of the system, variations in fuels, etc. may cause the basic desired speed signal to deviate from that precisely necessary. The signal representing actual vapor generator output vapor pressure from pressure sensor 52 is applied to comparator 76. It is compared to a reference signal representing the desired pressure (a constant) and an error signal is produced. Amplifier integrator 78 receives the error signal and delivers the integrated signal to amplifier 80 where it is added to the desired basic speed signal. The output of amplifier 80 is delivered to feed pump motor driver 16 causing motive fluid to be delivered at a particular rate. When the pressure sensor signal compares with the reference pressure signal, the error signal of comparator 76 becomes zero and amplifier integrator 78 maintains its output value. (In lieu of integral compensation, a droop system with sufficient gain may be employed to provide additional stability margins.)

In a similar manner, the signal representing actual vapor generator output vapor temperature is applied to comparator 82 and compared with a reference signal representing the desired temperature.

The integrated signal from amplifier integrator 78 is also applied to amplifier 84 through summing resistor 85. Amplifier 84 also receives the basic desired speed signal from amplifier 74 through summing resistor 75. Both of these inputs to amplifier 84 are tied together and also are connected to the feedback network represented by resistors 87 and 89 and capacitor 91 in a Tee configuration. Through this arrangement whereever the basic desired speed signal increases transiently the output of amplifier 84 will be a signal with an even greater increase. This signal is applied to amplifier 86 together with the error signal of comparator 82. The output of amplifier 86 is the drive signal for motor drive 22. In operation, an increase in the basic desired speed signal of amplifier 74 causes motor drive 22 to operate at a rate which anticipates or leads the basic desired speed signal. Consequently, the combustible mixture will be delivered to vapor generator 10 at a rate which is greater than the instantaneous demand, in anticipation of subsequent increased requirements. By this arrangement the lag normally to be expected in an external combustion system is reduced.

Figure 3:
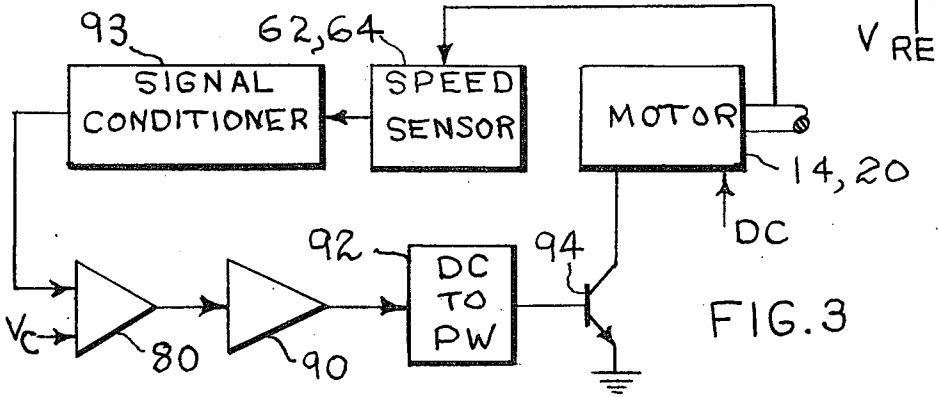
FIG. 3 shows schematically the details of the motor drives of FIG. 1.

Motor drives 16 and 22 are pulse width modulated speed control systems. Referring to FIG. 3, the command signal, $V_C$, from amplifier 80 or 86, as appropriate, is applied to comparator 88 as one input. The signal from the speed sensor (62 or 64) is made compatible with the command signal in signal conditioner 93 and applied as the second input to comparator 88 with an error signal being produced. Voltage amplifier 90 amplifies the error signal and applies it to DC to pulse width converter 92 where it is converted to a series of pulses the width of which is proportional to the speed error. These pulses are applied to the base electrode of transistor 94 to control the flow of electricity through the motor 14, 20. The power in a starting mode would be drawn from batteries 66, and in normal operation from the rectified output of alternator 32.

Figure 4:
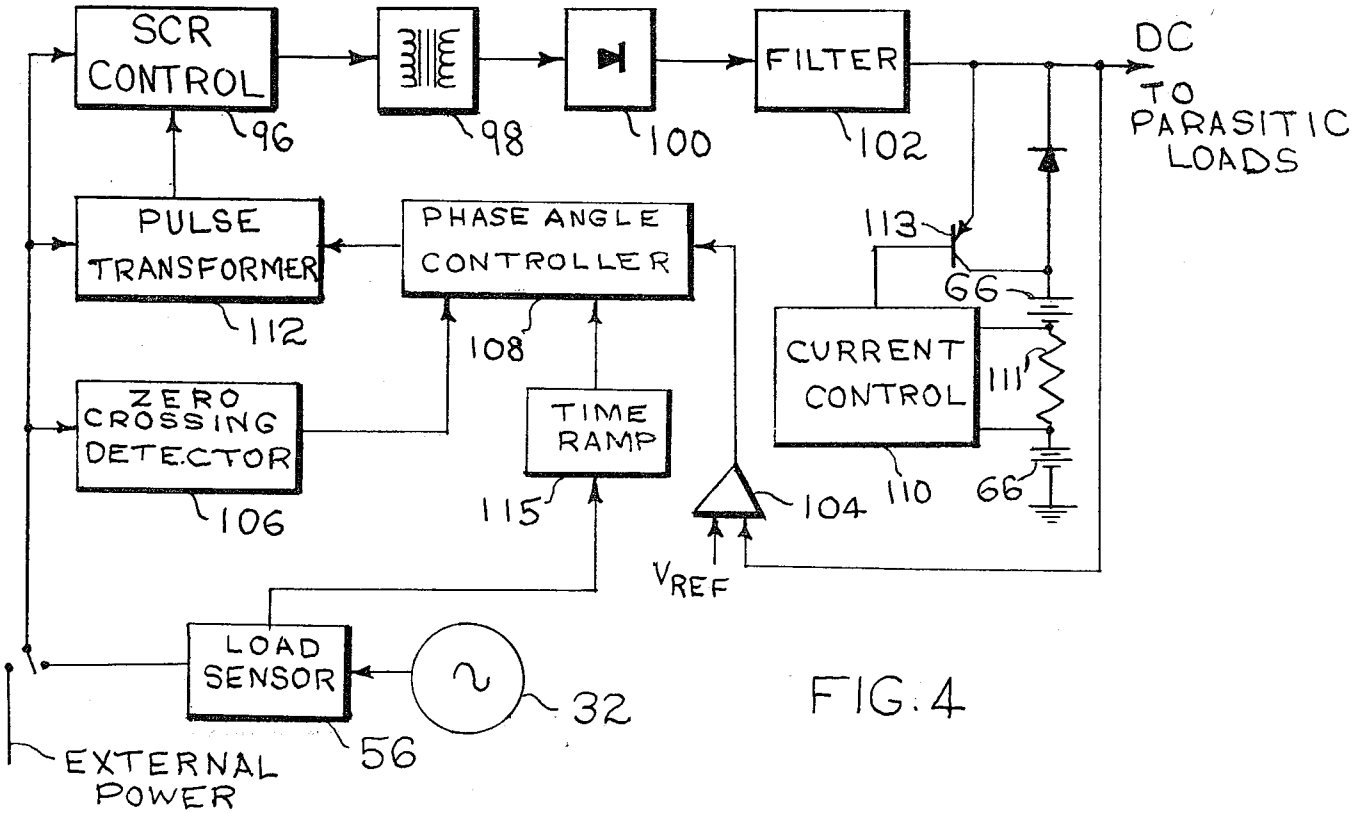
FIG. 4 shows schematically the details of the charger/load controller of FIG. 1.

Charger/load controller 58 of FIG. 1 will now be described by referring to FIG. 4. Alternator 32 is used as a source of power. Silicon controlled rectifiers 96 control the voltage supplied to transformer 98, by control of the phase angle at which they conduct. The output of transformer 98 is applied to full wave rectifier 100, and the rectified result is smoothed in filter 102. The resulting supply voltage is utilized to recharge the batteries and supplies the power for the parasitic loads of the system such as the motors driving the feed pump, fuel pump and blower. In addition this output voltage is compared with a desired reference voltage in comparator 104.

The alternating voltage of alternator 32 is also applied to zero crossing detector 106 to obtain synchronization pulses. These pules are applied to phase angle controller 108 with the output applied to pulse transformer 112 which produces alternating positive and negative pulses to gate SCR control 96.

During normal operation of the system SCR control 96 will be gated for most of each half cycle. The resulting voltage after filter 102 will be higher than the voltage on batteries 66. Current control 110 measures the current flowing through resistor 111 and regulates it to a desired amount by varying the voltage on the base of transistor 113.

When the system is first started or when a heavy load is suddenly put on the alternator (and sensed by the load sensor) phase angle controller 108 adjusts the firing of SCR control 96 to a small portion of the half cycles. This effectively takes the parasitic loads off the alternator and reduces the voltage after filter 102. The voltage on batteries 66 is then higher than the line voltage, so the batteries supply the power for the/DC loads.

Responsive to the sensed increased load, flows to the vapor generator are increased accordingly. A particular system takes a certain time to respond with increased power, so phase angle controller 108 gradually increases the firing angle in accordance with the time ramp 115 for the system. Normal operation resumes at the end of this time.

Figure 5:
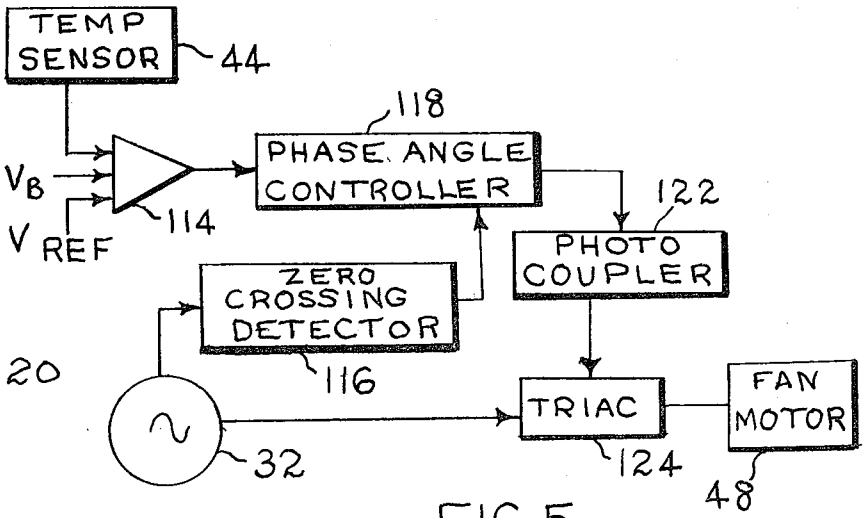
FIG. 5 shows schematically the details of the fan control of FIG. 1.

As previously indicated, fan motor 48 of FIG. 1 is operated at a speed which will provide the desired amount of cooling. Referring now to FIG. 5, the signal from temperatue sensor 44 is applied to comparator 114 along with a voltage $V_{REF}$ representing the desired temperature. A bias voltage $V_B$ is also applied to comparator 114 which assures that fan motor 48 will always run at least at a certain minimum speed.

The 60 Hz signal of alternator 32 is applied to zero crossing detector 116 to obtain synchronization pulses which are applied to phase angle controller 118 with the output used to trigger error pulses from comparator 114. These pulses, the timing of which varies as a function of the error signal and which are synchronized with the 60 Hz alternator output, are applied through photo coupler 122 to drive triac gates 124. That is, somewhere between successive zero crossings of the 60 Hz signal, the triacs are gated to provide power to the fan motor for a larger or smaller part of the half cycle to provide greater or lessor speed respectively. The photo coupler is a commercially available device which provides electrical isolation between the direct and alternating currents while employing light to send the control signal through. The variable voltage on the AC fan motor controls speed.

In the operation of one system, a timed sequence is employed in starting. Upon initiation, motors 14 and 20 are started, but operated at lower than normal speed. Fuel is not supplied during this ten second period so that any residual fuel in the combustor will be purged. After this ten seconds, a solenoid activated valve opens the fuel supply and the ignitor (typically a spark ignitor) is activated. A flame detector is employed which will cause the fuel flow to be cut off if ignition is not detected in the next ten seconds. Assuming ignition, over the next forty seconds, motors 14 and 20 are gradually brought up to their idle speeds. At this time the clamps which control and limit the speed are removed, and speed is a function of load as heretofore described.

If ignition is not sensed by the twenty second point, the fuel solenoid is closed and the ignitor is turned off, but the motors continue to operate at their start speeds for 30 seconds to purge the combustion chamber.

Since the sequencing is based on time, conventional circuitry can be used for implementation. For example, in an analog approach, an integrator produces a voltage ramp which is applied to threshold detectors which are gated when the voltage reaches the threshold levels.

In a digital form a clock and counters may be employed to obtain output signals at desired times.

Although a specific embodiment of a control system for an external combustion power system has been illustrated and described, it will be obvious that changes and modifications can be made without departing from the spirit of the invention and the scope of the appended claims.

We claim:

1. A control system for an external combustion power system having a vapor generator for vaporizing motive fluid, a prime mover driven by said vaporized motive fluid, and an alternator driven by said prime mover comprising:

means for sensing the electrical load on said alternator;

means responsive to said load sensing means for adjusting the flows of fuel and air to said vapor generator;

means responsive to said load sensing means for adjusting the flow of motive fluid to said vapor generator;

means for sensing the temperature of said vaporized motive fluid as it leaves said vapor generator;

means for sensing the pressure of said vaporized motive fluid as it leaves said vapor generator;

means responsive to said temperature and pressure sensing means for moderating the flow of fuel and air to said vapor generator; and means responsive to said pressure sensing means for moderating the flow of motive fluid to said vapor generator.

2. A control system in accordance with claim 1 further including:

condenser means for receiving the expanded vapor exhausted by said prime mover and condensing it;

fan means for supplying cooling air to said condenser means;

temperature sensing means for measuring the temperature of the condensate leaving said condenser means; and control means responsive to said temperature sensing means to adjust the flow of cooling air supplied by said fan means.

3. A control system in accordance with claim 1 wherein:

said means responsive to said load sensing means for adjusting the flows of fuel and air to said vapor generator, reponds to an increase in load signal by adjusting the fuel and air flows in excess of the amount required to supply the increase.

4. A control system for an external combustion power system having a vapor generator for vaporizing motive fluid and a prime mover driven by said vaporized motive fluid comprising:

means for sensing the load on said prime mover;

means responsive to said load sensing means for adjusting the flows of fuel and air to said vapor generator;

means responsive to said load sensing means for adjusting the flow of motive fluid to said vapor generator;

an alternator driven by said prime mover;

rectifying means for converting a portion of the power produced by said alternator to direct current;

a battery;

a plurality of direct current loads;

mmeans responsive to sensed loads to apply said direct current to recharging said battery when said loads are nominally constant, and to terminate for a time said rectification when said loads are increased in excess of the residual capacity of said power system to carry them; and said battery supplying said direct current loads when rectification is terminated.

* * * * *